United States Patent [19]

Eppinger

[11] Patent Number: 4,765,218

[45] Date of Patent: Aug. 23, 1988

[54] ELECTRONIC KEYBOARD MUSICAL INSTRUMENT WITH PROCESSING OF DEPRESSION DYNAMICS

[75] Inventor: Siegfried Eppinger, Trossingen, Fed. Rep. of Germany

[73] Assignee: Matth. Hohner AG, Trossingen, Fed. Rep. of Germany

[21] Appl. No.: 909,517

[22] Filed: Sep. 19, 1986

[30] Foreign Application Priority Data

Sep. 26, 1985 [DE] Fed. Rep. of Germany ..... 3534250

[51] Int. Cl.[4] ..... G10H 1/18; G10H 1/46

[52] U.S. Cl. ..... 84/1.01; 84/1.1; 84/1.27; 340/365 S; 340/365 L

[58] Field of Search ..... 84/1.01, 1.1, 1.27, 84/DIG. 7; 340/365 R, 365 S, 365 L

[56] References Cited

U.S. PATENT DOCUMENTS

| | | | |
|---|---|---|---|
| 3,594,487 | 7/1971 | Jones | 84/1.1 |
| 3,614,287 | 10/1971 | Klann | 84/1.01 |
| 3,652,774 | 3/1972 | Ohno . | |
| 3,902,397 | 9/1975 | Morez et al. | 84/1.27 |
| 4,520,706 | 6/1985 | Deforeit . | |
| 4,558,623 | 12/1985 | Buchla | 84/1.1 |
| 4,628,785 | 12/1986 | Buchla | 84/1.1 |

*Primary Examiner*—S. J. Witkowski

*Attorney, Agent, or Firm*—Frishauf, Holtz, Goodman & Woodward

[57] ABSTRACT

A keyboard circuit for an electronic musical instrument which, with the depression of a key, couples an AC signal to an allocated multiplexer input. The output of the multiplexer is connected via a rectifier and a sample-and-hold circuit to a depression recognizing circuit. The coupling is preferably inductive.

18 Claims, 1 Drawing Sheet

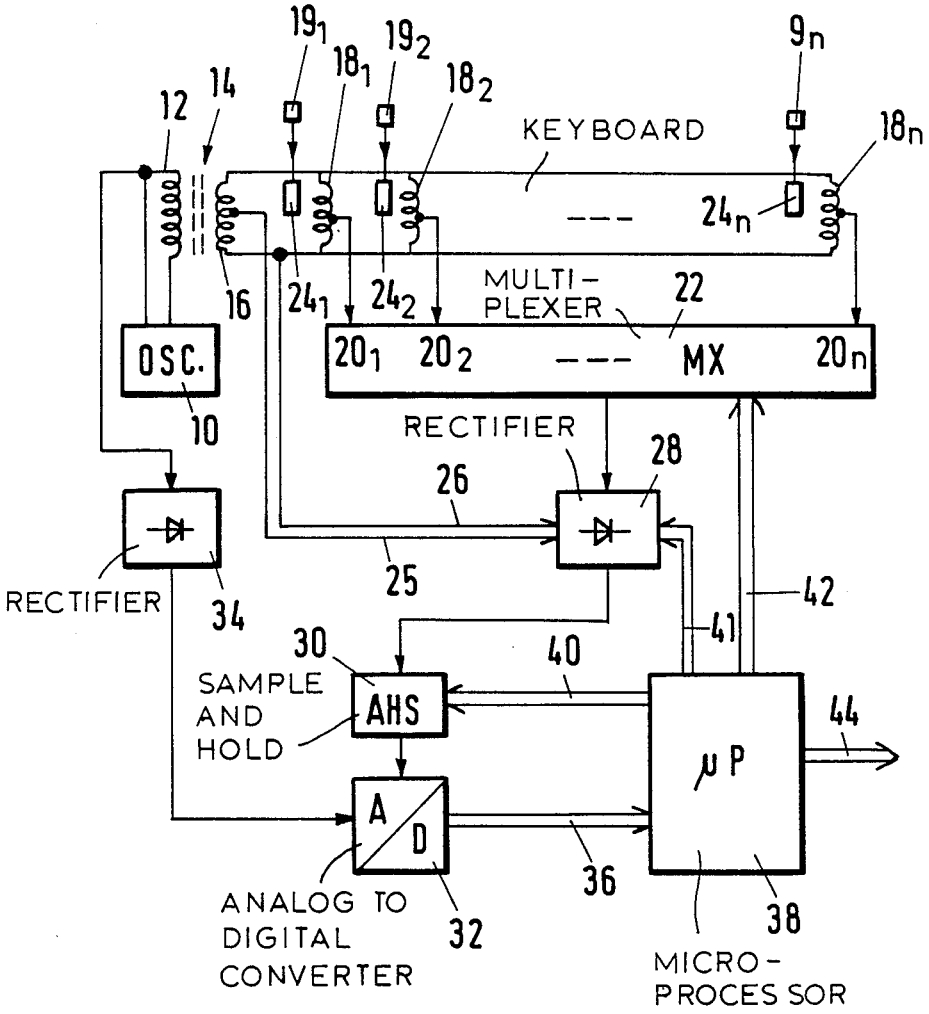
19₁
19₂
9n
18₁
18₂
12
14
KEYBOARD
18n
24n
16
24₁
24₂
MULTI-
PLEXER
22
OSC.
20₁
20₂
MX
20n
10
RECTIFIER
28
26
RECTIFIER
34
25
42
41
30
40
SAMPLE
AND
HOLD
AHS
44
μP
A
D
36
ANALOG TO
DIGITAL
CONVERTER
32
38
MICRO-
PROCESSOR

ELECTRONIC KEYBOARD MUSICAL INSTRUMENT WITH PROCESSING OF DEPRESSION DYNAMICS

BACKGROUND OF THE INVENTION

The present invention relates to an electronic musical instrument and, in particular, to a key depression recognition system of such an instrument.

Numerous electronic musical instruments are known which are provided with keyboards similar to those of conventional pianos. Such instruments comprise multiplex circuitry for periodically scanning pickup circuits allocated to each key. In its most simple form, such a pickup circuit comprises a pair of contacts closed (or opened) upon key depression. Contacts, of course, have poor reliability, particularly in an instrument which is in use over a period of years without being serviced. A system using optoelectronic pickup means to provide improved reliability is disclosed in German (Federal Republic) Pat. No. 30 07 156. Both systems, however, permit only the recognition of whether or not a key has been depressed.

It is desirable to obtain information about the depression dynamics, i.e. about the force or speed of key depression, in addition to recognition of the fact that a key has been depressed. U.S. Pat. No. 3,652,774 discloses an instrument having a first pickup means for identifying the depressed key comprising a coil in which, upon key depression, a voltage is induced by means of a permanent magnet mounted on the key. A second pickup means to provide depression dynamics information comprises a pressure-sensitive resistor, and the voltage drop over it is processed when the key exerts pressure. Such voltage drop varies with the pressure so that the player can produce special effects, even with the key being already depressed, by varying the depression holding force. A similar system is disclosed in U.S. Pat. No. 4,520,706 where the only pickup means is such a pressure-sensitive resistor. It will be understood that reliability problems are encountered with such deformable resistors also, and that their production tolerances lead to difficulties in the manufacturing process.

SUMMARY OF THE INVENTION

Accordingly, it is an object of the present invention to provide an electronic musical keyboard instrument having improved key depression recognition.

It is a further object of the present invention to provide key pickup means for an electronic musical instrument which is reliable, insensitive to wear and tear, and insensitive to dust and dirt.

It is a still further object of the present invention to provide a key pickup means for an electronic musical instrument wherein the pickup signal includes information about the depression dynamics.

These and other objects of the invention are achieved by one aspect of the present invention directed to an electronic musical instrument comprising keyboard means including a plurality of keys and circuit means for recognizing whether a particular key has been depressed. The circuit means includes multiplex circuit means for serially scanning output signals of the keys. The multiplex circuit has input terminals for each key and an output terminal, each key having coupling means for coupling an AC signal to its multiplex circuit input terminal upon depression. The multiplex circuit output terminal is connected via rectifying means and a sample-and hold circuit to an input of the recognizing circuit means.

In its preferred embodiment, the instrument has, for each key, a centrally tapped coil whose terminals are fed with AC voltage. A ferromagnetic core is operatively connected to each key so as to be moved relative to the allocated coil upon key depression, and the AC voltage picked up at the center tap varies accordingly. In conventional manner, the taps of each coil are sequentially addressed by multiplex circuitry so as to transfer a signal representative of the actual key position to processing circuitry. A recognizing circuit means is provided which detects amplitude variations from the taps of the coils, respectively, in successive multiplex cycles.

BRIEF DESCRIPTION OF THE DRAWINGS

The drawing is a block diagram of a key depression recognizing circuit of an electronic musical instrument in accordance with the invention. Of course, the instrument comprises many more circuits to produce sounds commensurate with depressed keys, but those circuits do not form a part of the present invention.

DETAILED DESCRIPTION OF THE PREFERRED EMBODIMENT

A generator 10 produces sine waves or triangular waves. It is preferred to use a conventional LC generator, and the inductor thereof can be the primary winding 12 of a transformer 14. The frequency of generator 10 is selected to be between 100 and 500 KHz. A secondary winding 16 of transformer 14 is connected to coils $\mathbf{18}_1, \mathbf{18}_2, \ldots, \mathbf{18}_n$ each having a central tap.

The central tap of each coil is connected to an allocated input terminal $\mathbf{20}_1, \mathbf{20}_2, \ldots, \mathbf{20}_n$ of an analog multiplexer 22. Operating in conventional fashion, multiplexer 22 completes within a preset multiplex time period a scan of all input terminals $\mathbf{20}, \mathbf{20}_2, \ldots \mathbf{20}_n$. When multiplexer 22 in the course of its scan reaches a certain one of its input terminals $\mathbf{20}_d$, then the voltage at input terminal $\mathbf{20}_d$ appears at the output of multiplexer 22 to be fed to circuit 28.

Each key $\mathbf{19}_1, \mathbf{19}_2, \ldots, \mathbf{19}_n$ carries a ferrite core. The term "carry" in this context is to be understood as referring to an operative connection such that upon depression of a key, its core $\mathbf{24}_1, \mathbf{24}_2, \ldots, \mathbf{24}_n$ is displaced. The displacement of core $\mathbf{24}_1, \mathbf{24}_2, \ldots, \mathbf{24}_n$ is between a first position where it is electromagnetically coupled with substantially only the upper half of its allocated coil and a second position where it is effective substantially only in the lower half of the coil. The core can, of course, be stopped at points between the first and second position to vary the signal amplitude on the center tap. Said operative connection between key and core may be very simple in that the core is directly mounted on the key, or lever systems or the like can be used to couple the core in such a manner as to move in response to key motion. It is, however, important that there always be a definite relationship between the actual key position and that of the core coupled to it.

The central tap of secondary winding 16 defines ground potential on line 25. With the key not depressed, the voltage at the central tap of the allocated coil is somewhat below that of ground. With the key halfway depressed, the tap potential equals that of ground, and with the key fully depressed, the tap potential is somewhat above ground potential. Accordingly, the pickup signal on the central tap of each key is of a bipolar nature. In order to have a unipolar signal, the voltage on line 26 from the lower terminal of secondary winding 16 is in part added to the pickup signal of each key, as explained below in a processible unipolar signal.

The bipolar signal at input terminal $20_1$, $20_2$, . . . $20_n$ is fed from the multiplexer 22 to a circuit 28 which is an amplifier and rectifier circuit adapted to effect a peak rectification after amplification of its input signal. In its amplifier portion, the phase of the supply voltage from oscillator 10—present on line 26—is compared with the actual phase of the multiplexed output from multiplexer 22. The output terminal of circuit 28 is connected to sample-and-hold circuit 30. The output amplitude of generator 10 is applied as a reference to analog-to-digital converter 32 via peak rectifier 34. This provides a compensation for amplitude variations in the output of oscillator 10.

The output of analog-to-digital converter 32 is connected, via bus 36, to microprocessor 38 which supplies, via buses 40, 41 and 42, the timing control signals for the multiplexer 22, synchronization of rectifier 28, and resetting of circuit 30, respectively. Output bus 44 of microprocessor 38 supplies to a sound generation circuitry (not shown) the actual digital output signal representative of the key depression dynamics.

With the start of each multiplex time period, circuit 30 is reset to zero within 2 μs. The sampling interval is 10 μs until the hold value is reached, and further 10 μs are used for the transfer to an analog-to-digital converter 32. These time intervals are commensurate with the minimum 100 KHz frequency of generator 10 in that within 10 μs there will appear at least one complete oscillation period. With the data given above, and assuming a keyboard comprised of 60 keys, each key will be scanned in intervals of about 1.5 ms, a delay sufficient to detect and process the depression dynamics.

The illustrated embodiment is advantageous because there is no need for individual adjustment of the coils 18 and because the entire system is relatively insensitive to contaminants. Preferably, adjacent coils 18 are wound in opposite winding directions so as to minimize magnetic leakage affecting nearby components.

Variations from the described embodiment will be readily apparent. For example, coils 18 could be replaced by differential capacitors with the coupling member operatively connected to the key being a movable capacitor plate. However, the inductive system is preferred because of its relatively low output impedance which is less sensitive to noise. Furthermore, the frequency of generator 10 could be reduced by replacing the simple rectifier 28 with a full wave rectifier, and it could be reduced even further by synchronizing the latter with the multiplex rate, as shown.

I claim:

1. An electronic musical instrument comprising a keyboard including a plurality of keys and identifying means for determining which of said plurality of keys has been depressed, said identifying means comprising:

multiplex circuit means for serially scanning output signals of said plurality of keys, said multiplex circuit means having a plurality of input terminals coupled, respectively, to each of said plurality of keys, and an output terminal;

each of said plurality of keys having coupling means for coupling an AC signal to its respective multiplex circuit means input terminal upon key depression;

rectifying means coupled to the output terminal of the multiplex circuit means;

a sample-and-hold circuit coupled to an output of the rectifying means; and an output of the identifying means coupled to an output of said sample-and-hold circuit.

2. An instrument according to claim 1, wherein said coupling means includes coils corresponding in number to said keys, each of said coils having first and second end terminals connected to an AC voltage source, a central tap connected to a respective multiplex circuit input terminal, and a ferromagnetic core operatively coupled to one of said plurality of keys and movable into its coil upon key depression.

3. An instrument according to claim 2, wherein one common AC voltage source is connected to the coils of all said plurality of keys.

4. An instrument according to claim 3, wherein said AC voltage produced by said source is applied to a rectifier circuit having its output signal applied to said identifying means as a reference signal.

5. An instrument according to claim 1, wherein said multiplex circuit means has a predetermined scan frequency, and wherein said AC signal has a frequency substantially exceeding said scan frequency.

6. An instrument according to claim 5, wherein said identifying means detects amplitude variations in successive multiplex cycles.

7. An instrument according to claim 2, wherein coils of adjacent keys of said plurality of keys are wound in opposite directions.

8. An instrument according to claim 3, wherein said AC voltage is produced by an LC oscillator comprising an inductor, said inductor being a primary winding of a transformer connected to supply said coils.

9. An instrument according to claim 1, wherein said AC signal is synchronized with a predetermined scanning rate of said multiplex circuit means.

10. An electronic musical instrument comprising:

a keyboard having a plurality of keys adapted to be movable when depressed;

signal generating means for each of the plurality of keys for producing an output signal at an output thereof, said signal generating means including an AC signal source, and coupling means connected to a key of said plurality of keys for coupling said AC signal source to said output of the signal generating means to vary the output signal amplitude corresponding to the distance travelled by a depressed key;

multiplex circuit means for sequentially scanning the output of said signal generating means for the plurality of keys, said multiplex circuit means having a plurality of input terminals coupled, respectively, to the output of each of said signal generating means, and an output terminal, said multiplex circuit means sequentially coupling its plurality of input terminals to its output terminal;

and identifying means coupled to the output terminal of said multiplexer circuit means for determining which of said plurality of keys has been depressed and the amplitude of the output signal produced by the signal generating means corresponding to the depressed key.

11. An instrument according to claim 10, wherein said coupling means includes coils corresponding in number to said plurality of keys, each of said coils having first and second end terminals connected to said AC signal source, a central tap connected to a respective multiplex circuit input terminal, and a ferromagnetic core operatively coupled to one of said plurality of keys and movable into its coil upon key depression.

12. An instrument according to claim 11, wherein one common AC signal source is connected to the coils of all said plurality of keys.

13. An instrument according to claim 12, wherein an AC signal produced by said AC signal source is applied to a rectifier circuit having its output signal applied to said identifying means as a reference signal.

14. An instrument according to claim 10, wherein said multiplex circuit means has a predetermined scan frequency, and wherein the output of said AC signal source has a frequency substantially exceeding said scan frequency.

15. An instrument according to claim 14, wherein said identifying means detects amplitude variations in successive multiplex cycles.

16. An instrument according to claim 11, wherein coils of adjacent keys of said plurality of keys are wound in opposite directions.

17. An instrument according to claim 12, wherein the output of said AC signal source is a voltage produced by an LC oscillator comprising an inductor, said inductor being a primary winding of a transformer connected to supply said coils.

18. An instrument according to claim 10, wherein the output of said AC signal source is a signal that is synchronized with a predetermined scanning rate of said multiplex circuit means.

* * * * *